United States Patent [19]

Coombs

[11] 4,286,339

[45] Sep. 1, 1981

[54] FIREMAN'S HELMET WITH ENERGY ABSORBING LINER

[76] Inventor: Peter A. Coombs, 62 Birkendene Rd., Caldwell, N.J. 07006

[21] Appl. No.: 966,397

[22] Filed: Dec. 4, 1978

[51] Int. Cl.[3] ..... A42B 3/02

[52] U.S. Cl. ..... 2/414; 2/416

[58] Field of Search ..... 2/6, 411, 412, 413, 2/414, 416, 425, 417–420, 410

[56] References Cited

U.S. PATENT DOCUMENTS

| | | | |
|---|---|---|---|
| 2,739,309 | 3/1956 | Frieder et al. | 2/416 |
| 2,923,941 | 2/1960 | Roth et al. | 2/416 |
| 2,971,195 | 2/1961 | Voss . | |
| 3,015,103 | 1/1962 | Zbikowski . | |
| 3,063,055 | 11/1962 | Voss . | |
| 3,208,080 | 9/1965 | Hirsch | 2/414 |
| 3,280,402 | 10/1966 | Scheibchen | 2/414 |
| 3,389,405 | 6/1968 | Fattori | 2/418 |
| 3,613,114 | 10/1971 | Hill et al. | 2/416 |
| 3,706,101 | 12/1972 | Plastino . | |
| 3,806,950 | 4/1974 | Spencer-Foote | 2/413 |
| 4,051,555 | 10/1977 | Daly | 2/412 |
| 4,101,983 | 7/1978 | Dera et al. | 2/414 |

FOREIGN PATENT DOCUMENTS

| | | | |
|---|---|---|---|
| 2359158 | 6/1975 | Fed. Rep. of Germany | 2/416 |
| 1227450 | 8/1960 | France | 2/416 |
| 945412 | 12/1963 | United Kingdom | 2/414 |

*Primary Examiner*—Werner H. Schroeder
*Assistant Examiner*—Andrew M. Falik

[57] ABSTRACT

Safety headgear includes an impact attenuating suspension system having a cradle of webbing and a non-resilient foam liner.

11 Claims, 4 Drawing Figures

FIREMAN'S HELMET WITH ENERGY ABSORBING LINER

This application is concerned with a safety helmet, particularly a fireman's helmet, which provides protection from impact on the helmet shell by attenuating impact energy or force transferred to the wearer's head. Increasing emphasis on avoidance of occupational injuries has caused attention to be directed to the design and the required wearing of protective headgear in the form of safety hats and helmets when conditions exist for head injuries due to impact. Applications for protective head gear include competitive sports such as football, recreational activities such as climbing, operation of vehicles such as motorcycles, bicycles, auto racing, hazardous industrial environments such as construction, lumbering, and earth moving, the military, aviation, and fire fighting.

Protective headgear for the foregoing activities usually comprises a rigid outer shell of metal or plastic and a suspension system which supports the shell on the wearer's head in a manner which attenuates impact force and distributes the force which is transferred to the head with the purpose of preventing the impacting object from contacting the head and reducing to a tolerable level the acceleration of the head resulting from the impact.

Impact attenuation suspensions principally take the form of a web of straps attached to the shell and arranged as a cradle over the top of the wearer's head, or take the form of a compressible foam liner which occupies most of the space between the wearer's head and the interior of the shell. The familiar "hard hat" of a construction worker is an example of a web suspension, whereas motorcycle helmets usually employ foam liners for impact attenuation.

Web suspensions provide better protecton than do foam lined helmets for a vertical blow on the top or apex of the helmet. Foam lined helmets provide better attenuation of lateral impacts than do web suspensions. Consequently, activities more likely to occasional lateral impacts than apex impacts are appropriate for the use of foam liner helmets, whereas activities where the hazard is more likely to be falling objects call for web suspensions. For this reason motorcycle helmets are usually foam liner suspension and industrial "hard hats" are web suspension.

Fire service is an exposure to apex impacts and to lateral impacts. Further, fire service entails a high rate of exposure to relatively severe impacts. Falling and toppling objects are common and the fireman's ability to avoid them is hampered by low visibility conditions and equipment burdens. Firemen are also subject to injury of a vehicular nature. Consequently, a fireman's helmet should provide a high degree of attenuation of lateral and of apex impacts. The impact attenuation system of a fireman's helmet, unlike those for lower risk activities, must survive an impact to continue to protect him as the fire continues. A suspension which sacrifically destructs during attenuation is not appropriate for firemen. Severe impacts can cause the sacrificial failure of either web or foam liner suspensions.

The present invention provides an impact attenuation suspension for a helmet such as a fireman's helmet which combines aspects of a web suspension with aspects of a foam liner suspension, thereby obtaining the benefits of each form of suspension with the surprising result of apex impact attenuation markedly superior to either web suspensions or foam liner suspensions while providing lateral impact attentuation at least as good as foam liner suspensions.

An embodiment of the invention executed as a fireman's helmet will be described with reference to the drawings in which.

Figure 1:
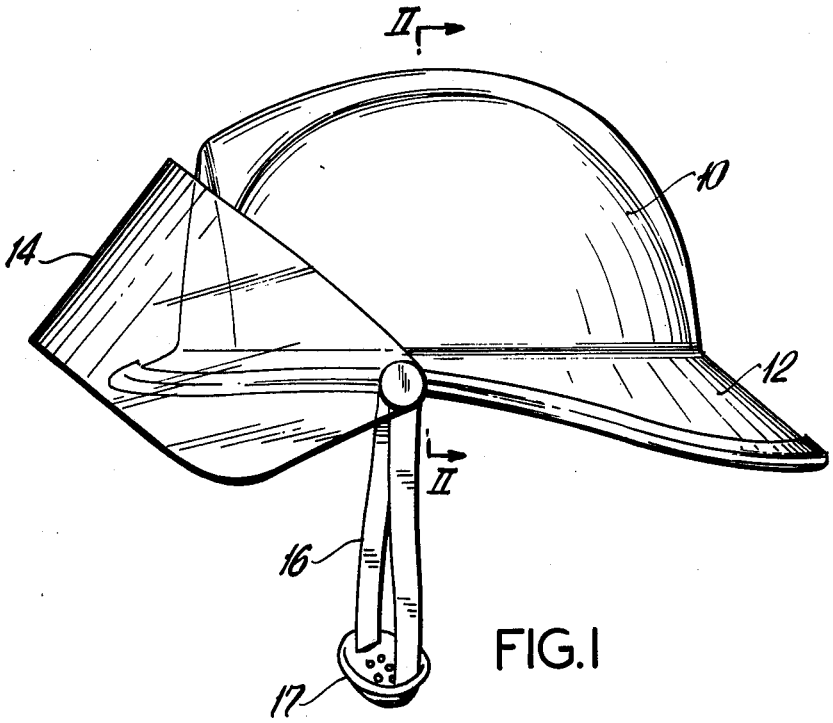
FIG. 1 is a profile view of a helmet embodying the invention.

Referring now to the drawings, FIG. 1 is a profile view of a fireman's helmet embodying the present invention. A shell 10 is provided with a brim 12 wider at the back than at the front to shield the back of the wearer's neck. A transparent visor 14 is provided to be lowered to provide eye protection. A chin strap 16 with a chin cup 17 assures that the helmet will stay in place. The overall appearance is an evolution of the traditional leather fire hat which has continued in use for well over a century.

Figure 2:
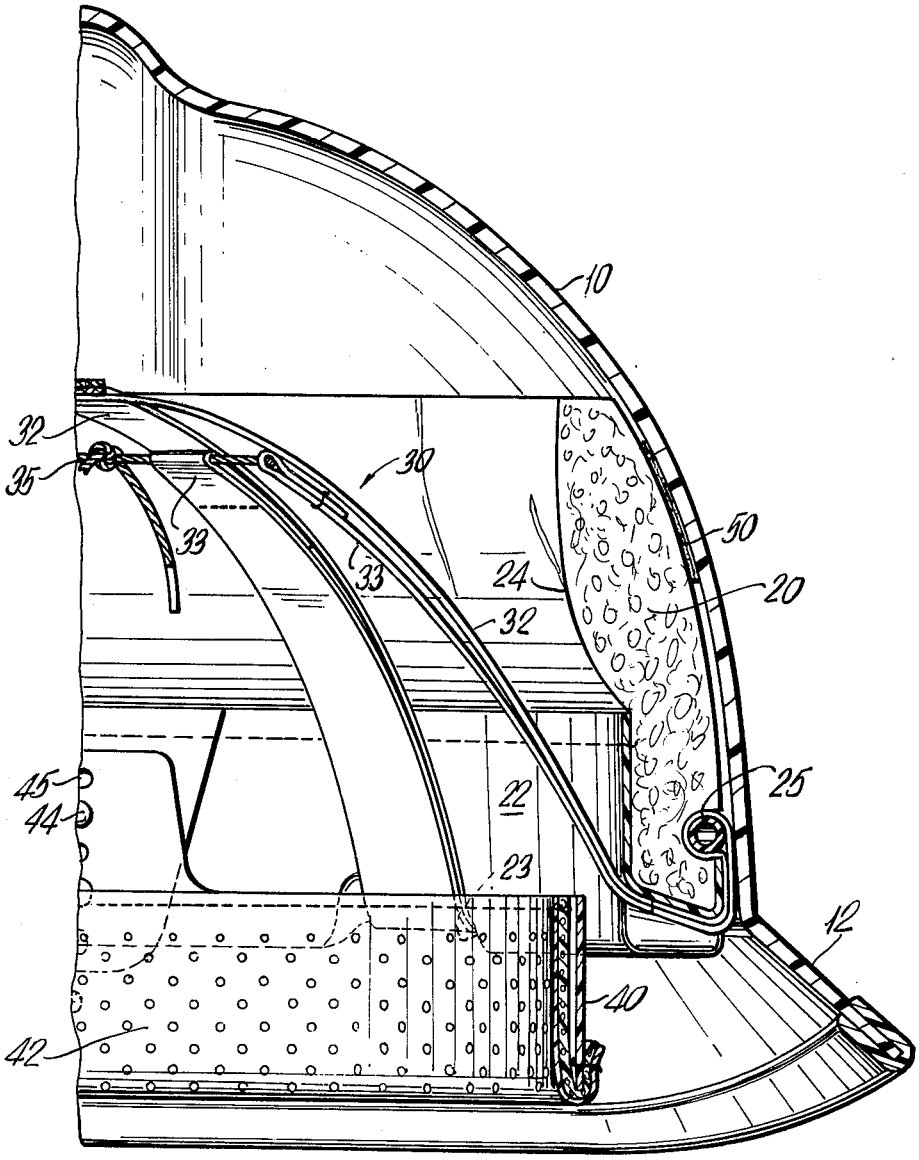
FIG. 2 is a view in cross-section along line II—II of the helmet of FIG. 1.
Figure 3:
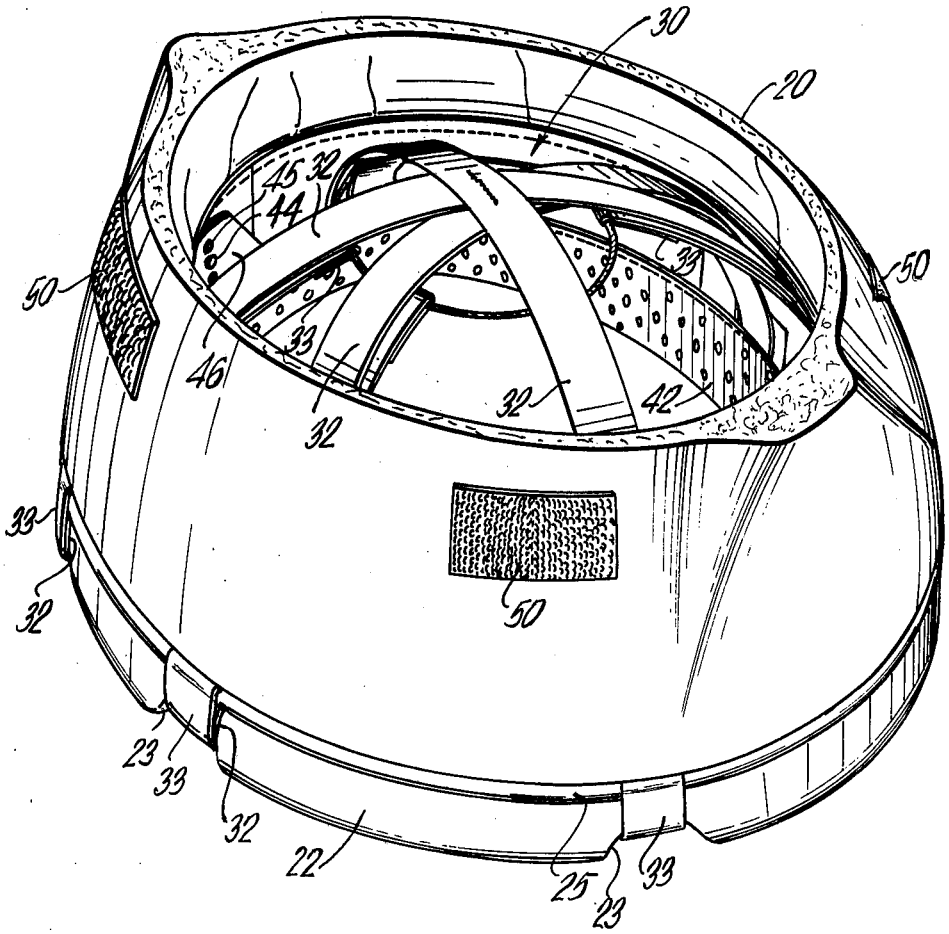
FIG. 3 is a perspective view of the suspension liner of the helmet.

FIG. 2 is a view in cross-section showing the suspension system of the present invention installed in the helmet shell 10. The suspension system comprises a non-resilient foam liner 20 in the general form of a ring, and a cradle 30 of a plurality of web straps 32,33. The helmet is supported on the wearer's head by an adjustable head band 40 lined with a sweat band 42. The headband 40 is attached to the foam liner by an adjustable system of holes and snap buttons 44,45 on tab extensions 46. The cradle of web straps can be adjusted. The wearer's head is spaced from the foam liner 20. The suspension system of the present invention operates only when sufficient force is applied to the helmet shell 10. The suspension system is frictionally fitted within the helmet shell 10. The exterior surface of the foam liner 20 corresponds to the interior surface of the helmet shell 10. The frictional retention of the suspension in the shell can be augmented by the use of patches 50 of hook and loop fastener material such as that sold under the trademark "Velcro".

The foam liner 20 is molded of a non-resilient foam material such as polyurethane. The interior shape of the liner includes an inwardly bulged region 24 for contacting the crown of the head in a lateral impact situation. The foam is chosen to be deformable under high lateral impact conditions to distribute the force of the impact over a relatively large area of the head and to absorb energy while deforming to reduce the lateral force transmitted to the head. The lower portion of the foam liner is encased in a formed plastic annular rim 22 of channel cross-sectional shape. The foam material is molded into the rim 22. The rim 22 is preferably formed of acrylic-polyvinyl chloride polymer. The rim 22 serves as a durable and attractive finish for the foam material and serves to distribute forces imposed by the web straps 32,33 of the cradle 30. Notches 23 formed in the rim 22 accomodate the web straps.

The cradle 30 comprises a plurality of radially disposed straps of strong webbing such as nylon stitched together at the central apex of the cradle. Each strap 32 proceeds from the apex to the lower rim 22 of the foam liner 20 at a notch 23 formed in the rim 22. The strap 32 wraps about the rim 22 and proceeds upwardly along the outer surface of the liner, wraps about a tube 25 inset in a groove in the outer surface of the liner, and then proceeds back around the lower rim 22 of the liner to approach the apex as a free end with a loop 33. The loops 33 of free ends of the straps are collected by a draw string 35 which is knotted to allow adjustment of the cradle 30 to suit the individual.

The tube 25 is a relatively thick walled, fairly rigid tube of resilient polymer such as polyethylene. An annular groove encircles the foam liner 20 at a point just above the upper, outer edge of rim 22. The groove is sized to frictionally receive the tube about which each of the straps 32 is wrapped. The helmet liner confines the tube 25 in the groove.

In operation, the suspension attenuates and distributes an impact force on apex impact such as a falling object, the shell 10 is forced downwardly with respect to the liner. Some of the force is attenuated by non-destructive deformation of the liner and by frictional energy dissapation between the liner and shell. The remaining force is transmitted downardly of the foam liner and is further attenuated by compression of the foam. The then remaining force is transmitted to the web straps 32 through the tube 25. The tension of the straps 32 tends to flatten the tube 25. The remaining force is transmitted through the cradle 30 of straps 32 to the head. The straps stretch to further dissipate energy. The residual force is distributed about the wearer's head by the cradle 30 of straps. Each step in the transfer of force from the impact to the head dissipates energy through friction or reduces transmitted force by collapse or both. In the case of a lateral impact on side blow, the force is attenuated by a similar compression of the foam liner 20 and resilient transfer through the straps. The bulge 24 of the foam liner 20 will contact the head and deform in a severe lateral blow to further attenuate and distribute the force to a large area of the head.

Figure 4:
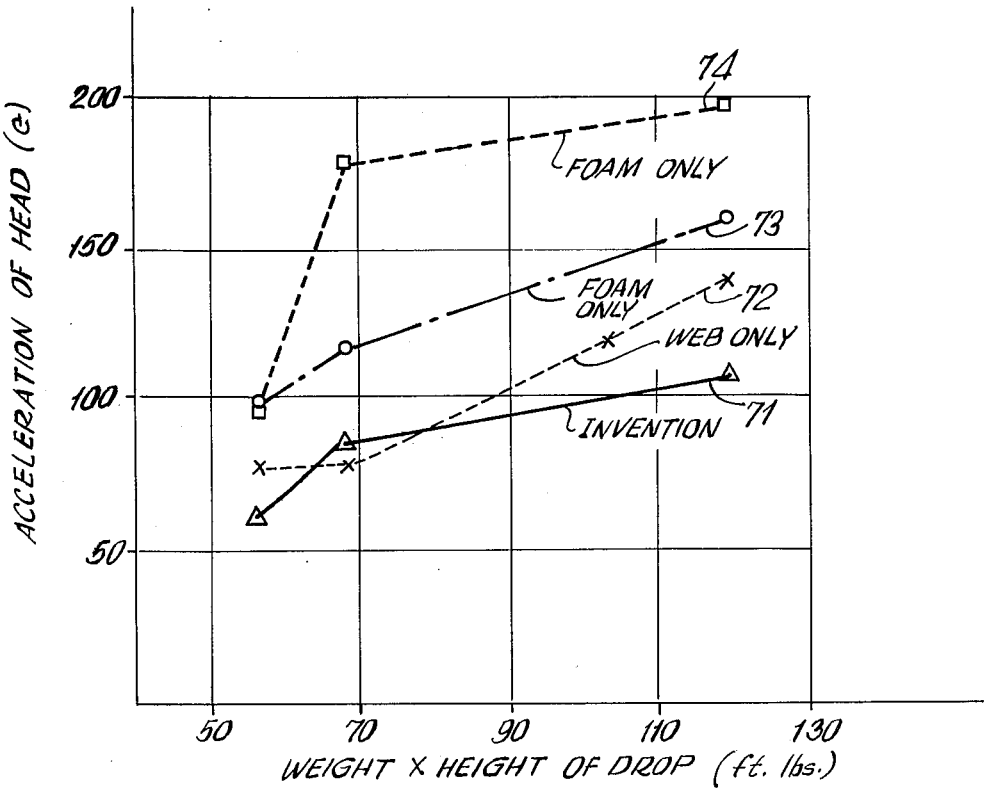
FIG. 4 is a graph plotting data comparing impact attenuation of a helmet in accordance with the present invention with helmets having prior suspensions.

FIG. 4 plots data comparing a fireman's helmet according to the invention with web suspension and foam liner fireman's helmets. The apparatus employed is that described in the American National Standard, Specification for Protective Headgear for Vehicular Users (ANSI Z90.1-1973). The apparatus comprises a headform instrumented to measure acceleration of the headform delivered by impacts of a known weight dropped from known height. The results plotted in FIG. 4 are for apex impacts. The helmet according to the invention caused a peak acceleration of but 110 $G_n$ (acceleration) at a potential energy of 120 ft.lbs. whereas the web suspension caused 140 $G_n$ and foam liner suspensions caused up to 200 $G_n$. At a low impact potential energy of 55 ft.lbs. the helmet of the invention caused about half the acceleraation of the foam liners and was better than the web suspension. At an intermediate impact potential energy of 66 ft.lbs. the web suspension was comparable to the present invention whereas the foam liner helmets caused as much as triple the head acceleration. From the foregoing data it can be concluded that under conditions of apex impacts, the helmet of the present invention surpasses helmets having only a web suspension and is vastly superior to helmets having only foam liners.

Tests comparing the helmet of the present invention with web only and foam liner only suspensions under conditions of lateral impact showed the present invention to be at least equal to the foam liner helmets and vastly superior to the web suspension helmets.

The helmets tested were a helmet as described herein for data 71, a web suspension fireman's helmet having a polycarbonate shell to which the web straps were directly fastened for data 72, a polyether foam liner in a polycarbonate fireman's helmet shell for data 73, and a polystyrene foam liner in a fiberglass fireman's helmet shell for data 74. The web suspension helmet which performed better than the helmets other than that of the invention did not survive the testing. One of the straps of the web suspension broke severely imparing the ability of the helmet to further protect the fireman. The helmet of the invention was uninjured by the testing and was capable of providing undiminished continuing protection for the wearer.

I claim:

1. A fireman's helmet having an impact attenuation suspension comprising polymeric helmet shell, a non-resilient foam polymer liner in the form of a ring having an exterior conforming to the interior of the shell, a cradle of straps of webbing for engagement with the wearer's head under conditions of impact, said cradle comprising a plurality of straps arranged radially from a central apex outwardly and downwardly to the lower rim of the foam liner, about the rim and upwardly on the exterior of the foam liner, thence about a resilient member inset in a groove which encircles the exterior of the foam liner, thence downwardly and about the lower rim and toward the apex to a drawstring for adjustment of the cradle size, the lower rim of the foam liner being encased in a ring of channel cross-section formed of a relatively rigid polymer, and a headband secured to the foam liner for supporting the helmet on the wearer's head.

2. The helmet of claim 1 wherein the helmet shell is polycarbonate, and the liner is polyurethane foam.

3. Headgear for protecting the wearer's head by attenuating impact comprising a relatively rigid outer shell, a removeable non-resilient polymer foam liner fitted to the interior of the shell with clearance from the wearer's head, the lower rim of the foam liner being encased in a ring of channel cross-section formed of a relatively rigid material, and a cradle of straps of webbing adapted to engage the top of the wearer's head under conditions of impact, the straps of the cradle passing around the ring on the lower rim of the foam liner and secured to a resilient means on the outside of the liner adjacent the inner surface of the outer shell.

4. The headgear of claim 3 wherein the foam liner is in the general form of an annular ring.

5. The headgear of claim 3 wherein the resilient means is filled in a groove which exceedes the outside of the foam liner above the encasing ring.

6. The headgear of claim 4 wherein the resilient means is a thick walled polyethylene tube.

7. The headgear of claim 4 wherein the tube is adjacent the inner surface of the outer shell.

8. The headgear of claim 3 wherein the foam liner is formed from polyurethane foam.

9. The headgear of claim 8 wherein the outer shell is polycarbonate.

10. The headgear of claim 3 wherein the encasing ring is acrylic-polyvinyl chloride polymer.

11. The headgear of claim 3 wherein the foam liner conforms to the interior of the outer shell and is retained therein by friction.

* * * * *